US005137492A

United States Patent [19]

Archer et al.

[11] Patent Number: 5,137,492

[45] Date of Patent: Aug. 11, 1992

[54] STRIP VENTILATOR

[75] Inventors: Matthew T. Archer, Acton; Martin P. Godward, Hammersmith; Michael A. Ganss, Richmond, all of England

[73] Assignee: R. W. Simon Limited, Torrington, England

[21] Appl. No.: 785,193

[22] Filed: Nov. 1, 1991

Related U.S. Application Data

[63] Continuation of Ser. No. 579,764, Sep. 10, 1990, abandoned.

[30] Foreign Application Priority Data

Sep. 11, 1989 [GB] United Kingdom ..... 89205017

[51] Int. Cl.[5] ..... F24F 13/18

[52] U.S. Cl. ..... 454/213; 454/226

[58] Field of Search ..... 454/213, 226

[56] References Cited

U.S. PATENT DOCUMENTS

| | | | |
|---|---|---|---|
| 1,294,145 | 2/1919 | Nelson | 98/99.7 |
| 1,407,129 | 2/1922 | Crouch | 98/99.01 |
| 1,668,019 | 5/1928 | Kaufman | 98/99.1 |
| 1,924,284 | 8/1933 | Kohler | 98/99.1 |
| 4,019,429 | 4/1977 | Sado | 98/98 |
| 4,295,417 | 10/1981 | Isley | 98/98 |

FOREIGN PATENT DOCUMENTS

| | | | |
|---|---|---|---|
| 0110436 | 10/1983 | European Pat. Off. . | |
| 1934996 | 1/1971 | Fed. Rep. of Germany | 98/98 |
| 1950922 | 5/1971 | Fed. Rep. of Germany . | |
| 2261822 | 1/1974 | Fed. Rep. of Germany | 98/98 |
| 2703207 | 8/1978 | Fed. Rep. of Germany | 98/98 |
| 3519947 | 1/1986 | Fed. Rep. of Germany | 98/99.7 |
| 1574282 | 7/1969 | France . | |
| 7812763 | 4/1978 | France . | |
| 886586 | 4/1981 | France . | |
| 7903031 | 4/1979 | Netherlands | 98/98 |
| 2039028 | 7/1979 | United Kingdom | 98/98 |
| 2168801 | 12/1984 | United Kingdom . | |

*Primary Examiner*—Albert J. Makay
*Assistant Examiner*—William C. Doerrler
*Attorney, Agent, or Firm*—Jenner & Block

[57] ABSTRACT

A ventilator comprises an elongate strip (10) formed as a single component including an integral formation (19,23) extending adjacent an intermediate portion (13), the formation defining an opening (24,33) which is below openings (22) in the intermediate portion (13) thereby ensuring that there is no direct passage to and from the said openings (22) in the intermediate portion (13) in a direction normal thereto.

9 Claims, 9 Drawing Sheets

STRIP VENTILATOR

Figure 2:
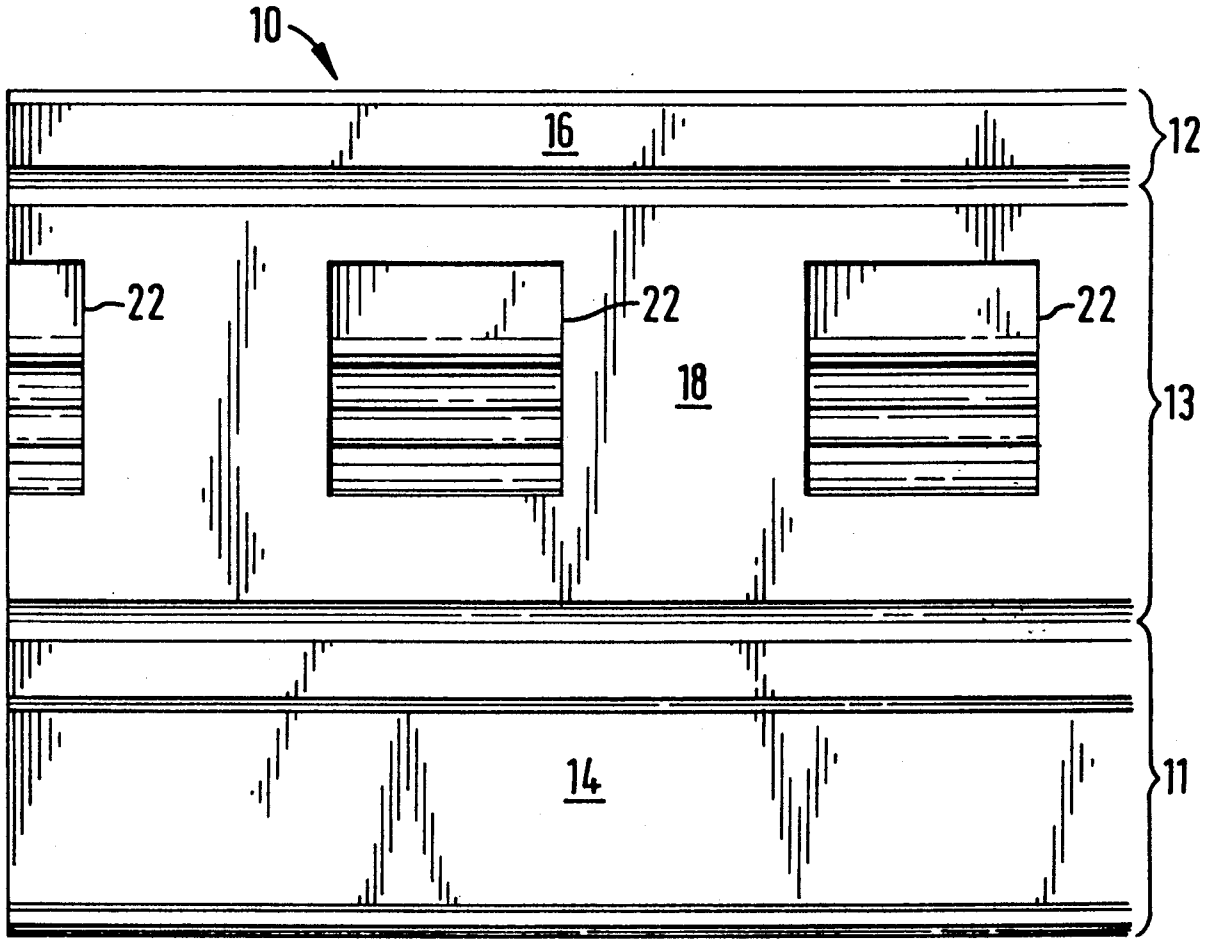

This application is a continuation of application Ser. No. 07/579,764 filed Sept. 10, 1990 now abandoned.

This invention relates to a strip ventilator.

A strip ventilator generally comprises an elongate strip of rigid material having a lower portion for receiving an upper edge portion of a glazed panel, an upper portion for location in a window frame and an intermediate portion having at least one opening and, in combination with the strip, a shutter moveable relative to the intermediate portion to control airflow through the intermediate portion. An example of a strip ventilator is disclosed in GB 2 168 801A.

In order to reduce the cost of manufacture of strip ventilators, it is desirable to reduce the number of components which comprise each ventilator. This may be achieved by forming the strip as a single component whereby the upper, lower and intermediate portions are integral. However, it is generally necessary to provide such a ventilator with a hood so that there is no direct passage to and from the opening or openings of the intermediate portion in a direction normal thereto The presence of a hood thus reduces any tendency for extraneous air currents to pass through a ventilator when in an open condition.

The provision of a hood necessitates manufacture of a separate component and also requires skill, labour and time to assemble and secure each hood relative to a corresponding integral ventilator strip.

The invention is characterised in that an elongate strip is formed as a single component including an integral formation extending adjacent the intermediate portion, the formation defining an opening which is below the or each opening in the intermediate portion thereby ensuring that there is no direct passage to and from the said opening or openings in a direction normal thereto.

Following is description, by way of example only and with reference to the accompanying drawings, of one method of carrying the invention into effect.

Figure 1:
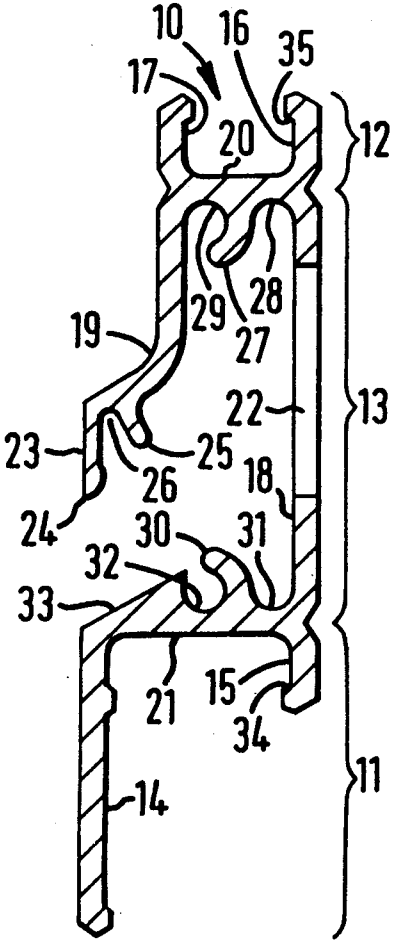
Figure 3:
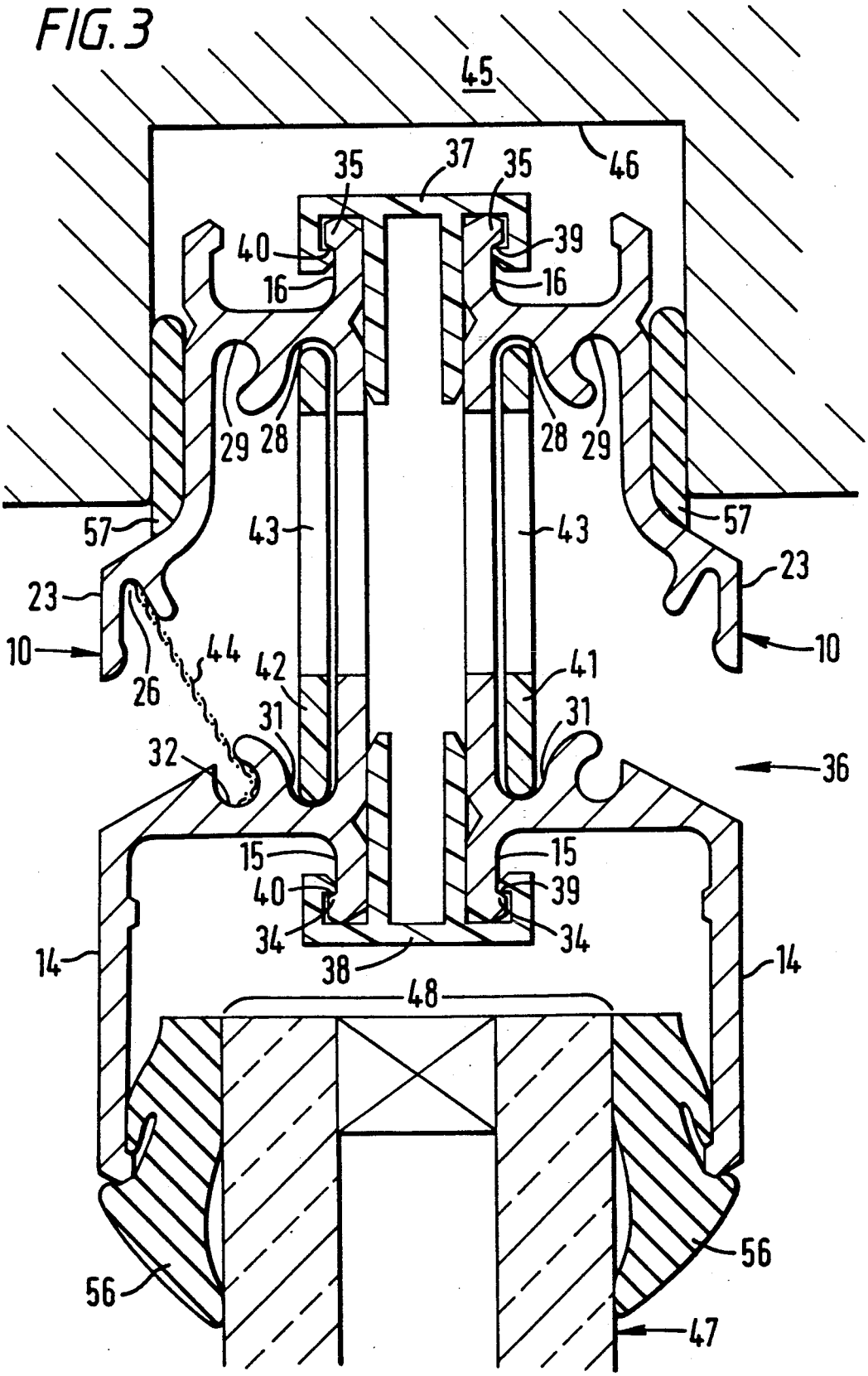
Figure 4:
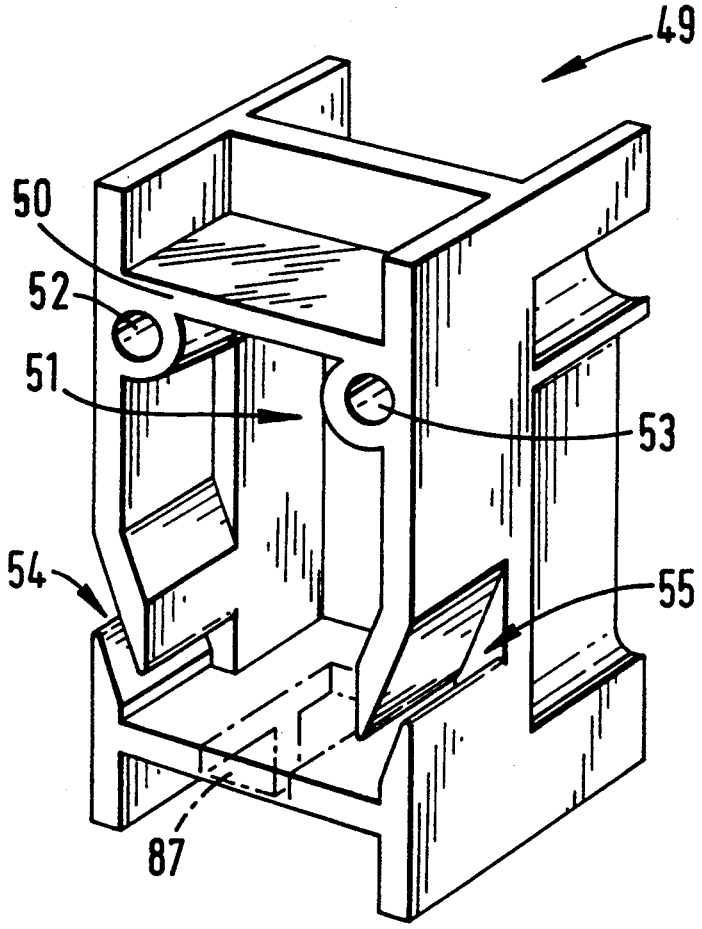
Figure 5:
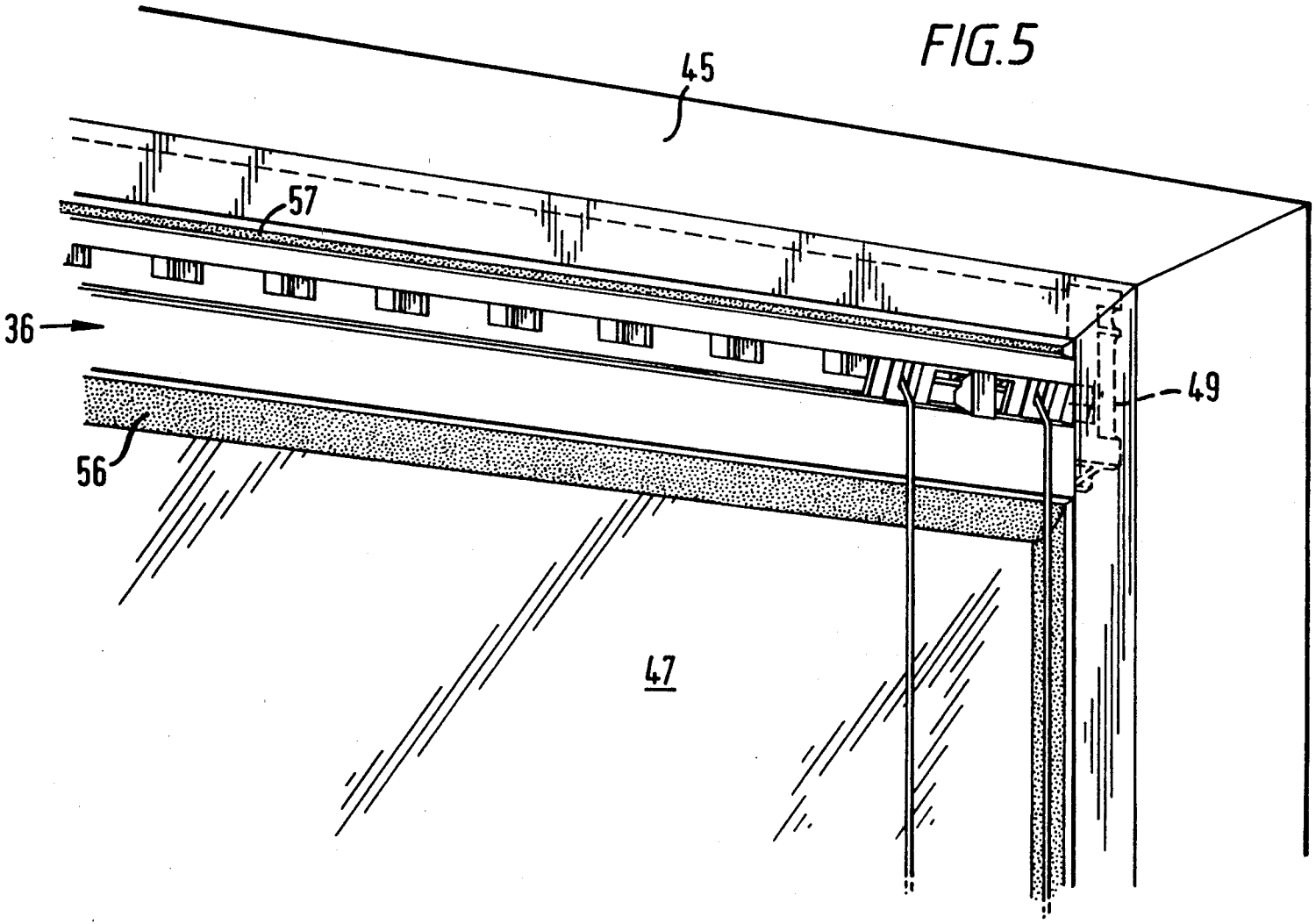
Figure 6:
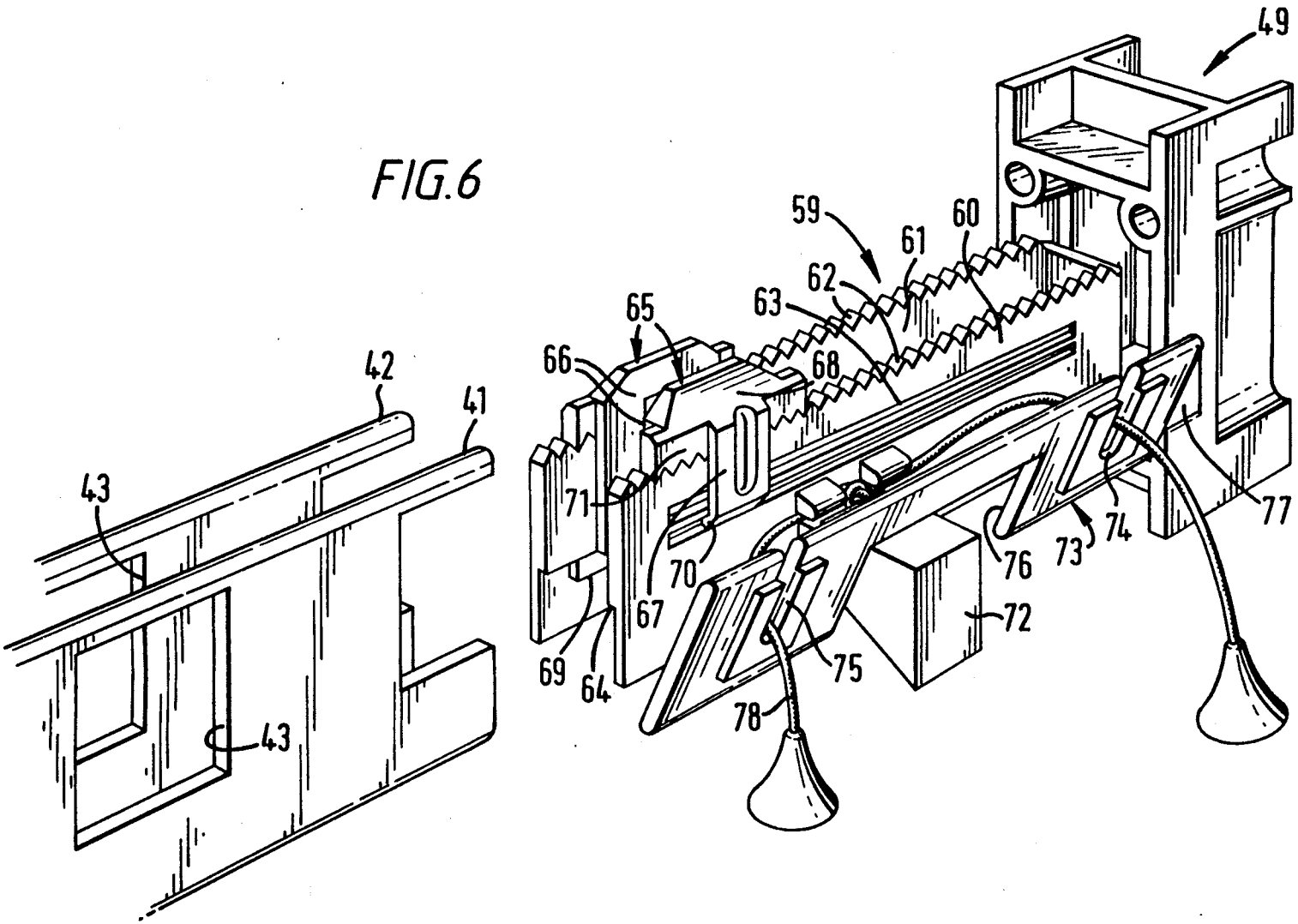

In the drawings:

FIG. 1 is a transverse cross section of an extrusion for use in one embodiment of a strip ventilator in accordance with the present invention, FIG. 2 is a diagrammatic elevation of the extrusion shown in FIG. 1, FIG. 3 is a transverse cross section of an embodiment of a strip ventilator comprising two extrusions of the type shown in FIGS. 1 and 2 combined in a window frame containing a unit of double glazed panels, FIG. 4 is a perspective view of an end cap for use with the embodiment of the strip ventilator shown in FIG. 3, FIG. 5 is a diagrammatic perspective view of the embodiment of the strip ventilator shown in FIG. 3 when in use, FIG. 6 is a diagrammatic representation of an operating device for moving in unison shutters of the embodiment of the ventilator shown in FIG. 3.

Figure 7:
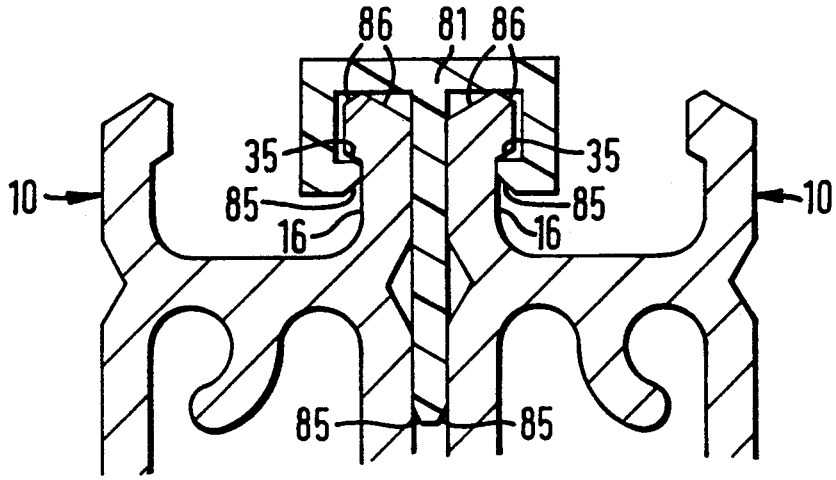
Figure 8:
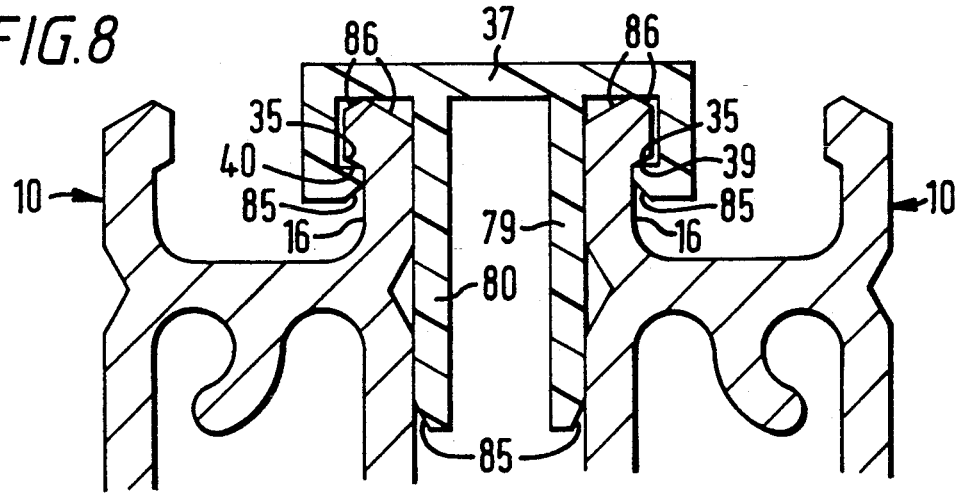
Figure 9:
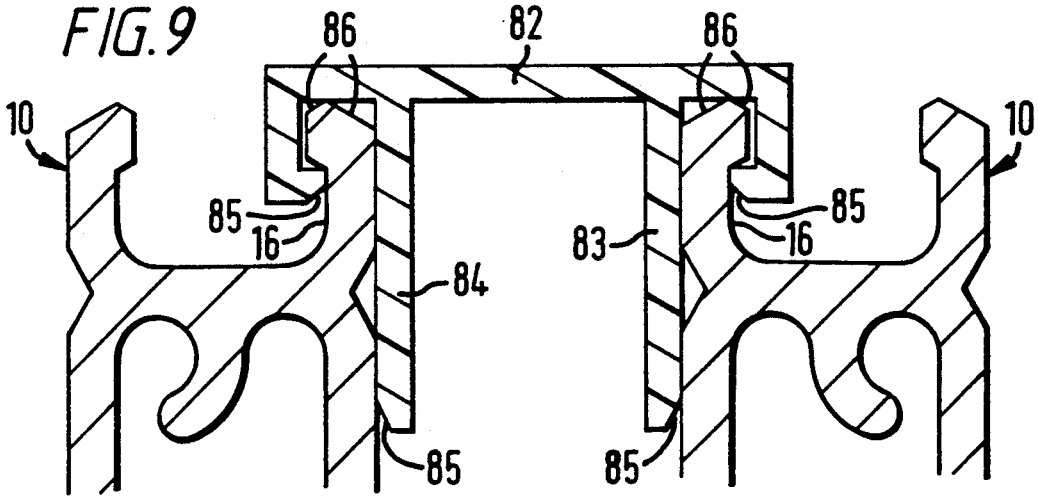

FIGS. 7,8 and 9 are diagrammatic representations showing different connecting members for combining with the two extrusions in the formation of the strip ventilator shown in FIG. 3.

Figure 11:
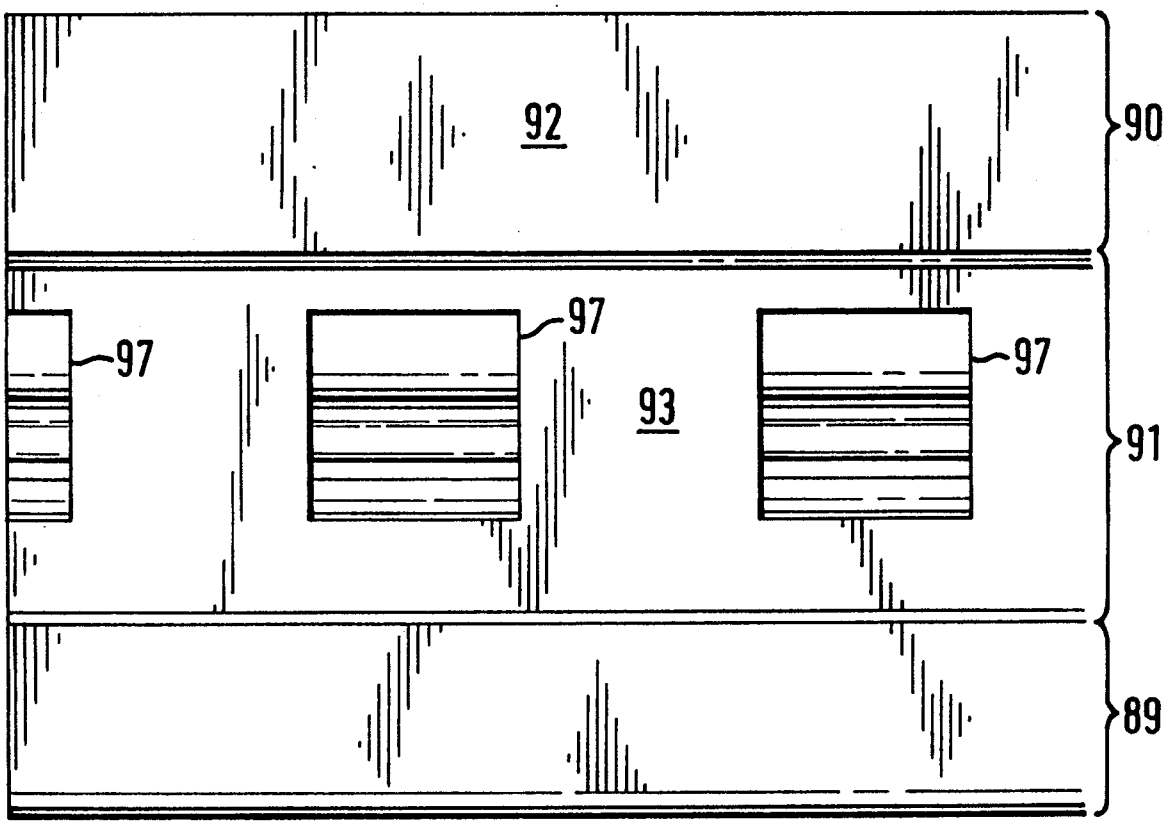
Figure 10:
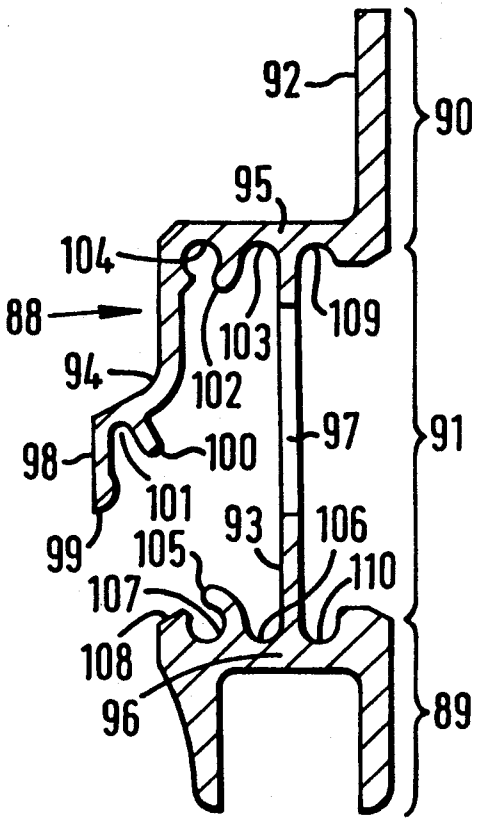
Figure 12:
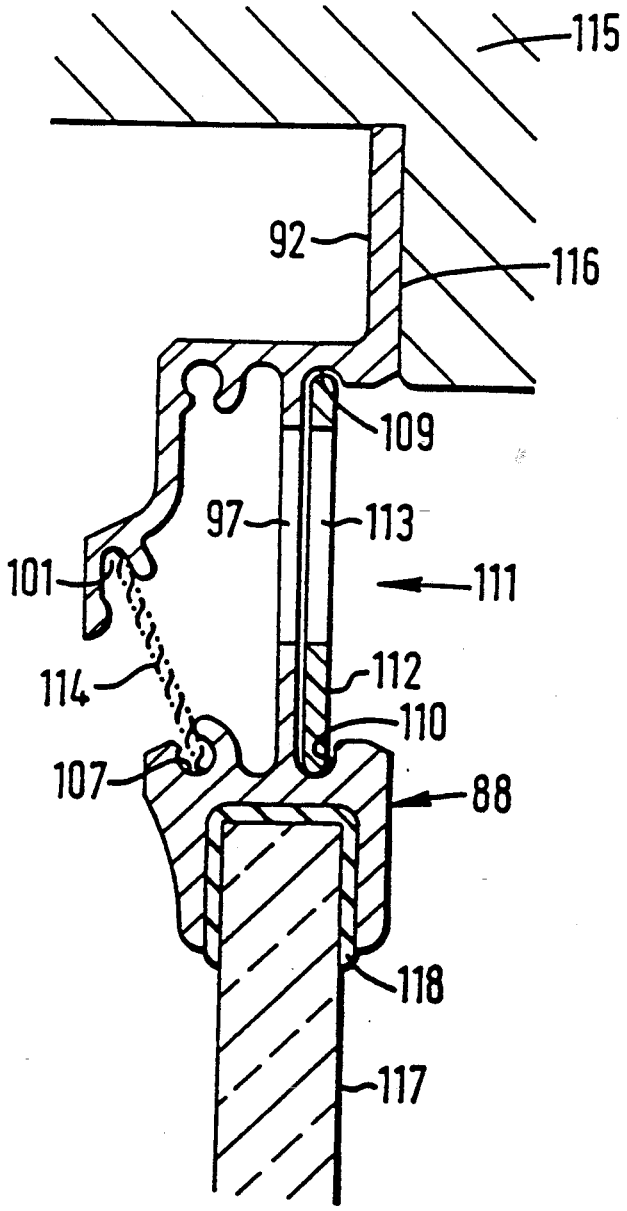
Figure 13:
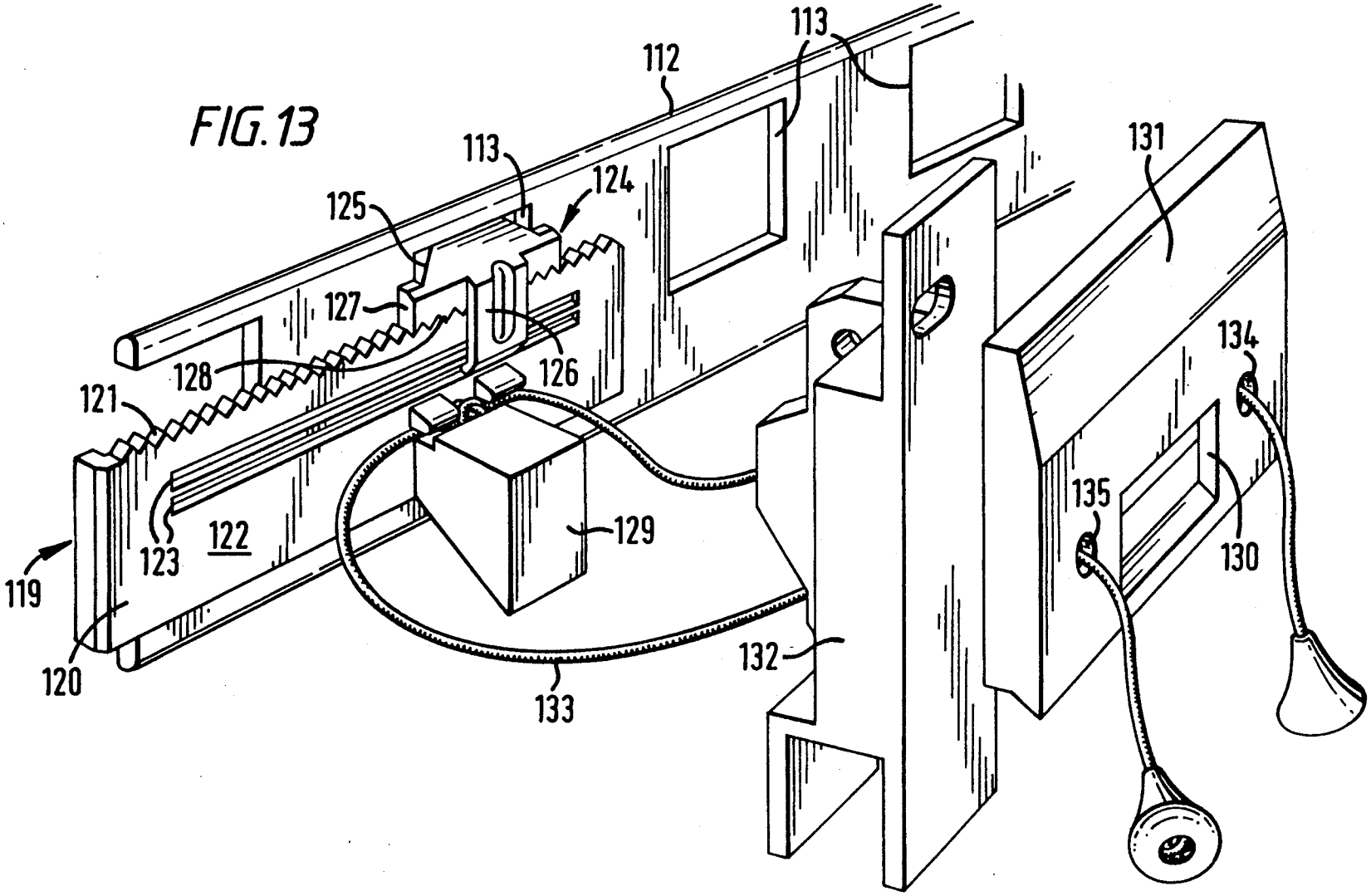

FIG. 10 is a transverse cross section of an extrusion for use in another embodiment of a strip ventilator in accordance with the present invention, FIG. 11 is a diagrammatic elevation of the extrusion shown in FIG. 10, FIG. 12 is a transverse cross section of another embodiment of a strip ventilator comprising an extrusion of the type shown in FIGS. 10 and 11 when installed in a window frame containing a single glazed panel, and FIG. 13 is a diagrammatic representation of an operating device for moving a shutter of the embodiment of the strip ventilator shown in FIG. 12.

Referring now to FIGS. 1 and 2 of the drawings, there is shown an extrusion 10 of aluminium comprising a lower portion 11, an upper portion 12 and an intermediate portion 13. The lower portion 11 is of substantially inverted U-shape transverse cross section one opposite facing portion 14 of which is of greater vertical dimension than the other opposite facing portion 15 thereof. The upper portion 12 of the extrusion 10 is of U-shape transverse cross section, the opposite facing portions 16 and 17 being of equal vertical dimension. The intermediate portion 13 comprises a rectilinear wall 18, a curved wall 19 and upper and lower bridge portions 20 and 21 connecting the walls 18 and 19 in spaced relation one to another.

The rectilinear wall 18 is provided with a series of square apertures 22 extending longitudinally of the extrusion 10. The curved wall 19 extends downwardly from the upper bridge portion 20 in a direction parallel to the rectilinear wall 18, then curves outwardly away from the rectilinear wall and continues in a downward direction parallel to the rectilinear wall 18 to form a skirt 23 having a lower lip 24. The curved wall 19 is provided with an internal longitudinally extending projection 25 which defines an internal longitudinally extending recess 26 at the junction of the curved wall 19 and the skirt 23. The skirt 23 is of such dimension that the distance of the lip 24 from the upper bridge portion 20 is at least as great as the distance of lower margins of the apertures 22 in the rectilinear wall 18 from the upper bridge portion 20. Also the distance of the lip 24 from the rectilinear wall 18 is substantially the same as the distance separating the opposite facing portions 14,15 of the U-shape lower portion 11 of the extrusion 10. In consequence, the lip 24 is located substantially vertically above the wall 14 of the lower portion 11 of the extrusion 10.

The upper bridge portion 20 is provided with an inwardly extending longitudinal projection 27 defining a longitudinal recess 28 adjacent the rectilinear wall 18 and a longitudinal recess 29 remote from the rectilinear wall 18. Similarly, the lower bridge portion 21 is provided with an inwardly extending longitudinal prcjection 30 defining a longitudinal recess 31 adjacent the rectilinear wall 18 and a longitudinal recess 32 remote from the rectilinear wall 18. The lower bridge portion 21 outwardly of the outer recess 32 slopes downwardly in a direction from the rectilinear wall 18, as shown at 33. The lower and upper extended portions 15, 16 are each provided with an inwardly extending flange 34,35.

Referring now to FIG. 3 of the drawings, there is shown a strip ventilator 36 comprising two extrusions 10 mounted in back to back configuration and secured one to another by means of a pair of elongate connecting members 37, 38 of plastics material each having a pair of inwardly turned flanges 39,40 for engaging with the corresponding flanges 34, 35 of the portions 15, 16 of the extrusions 10 and connecting the extrusions 10 in spaced relation one to another. The ventilator 36 also includes a pair of shutters 41, 42 each provided with a series of square apertures 43 similar to the square apertures 22 of the extrusions 10, the shutters 41, 42 each being located in a corresponding pair of the recesses 28, 31 of a corresponding extrusion 10 and slidable therein in a longitudinal direction of the extrusions 10. The ventilator 36 also includes an elongate mesh flyscreen 44 which is received in the recesses 26, 32 of one of the extrusions 10. The ventilator 36 is located in a window frame 45 having a rebate 46 and a double glazed unit 47 an upper edge 48 of which is spaced from an upper portion of the frame 45 such that when the upper edge 48 of the glazed unit 47 has the ventilator 36 received thereon the edge 48 is received between the opposite facing portions 14 of the two extrusions 10, the portions of the extrusions 10 extending upwardly beyond the curves of the walls 19 being received in the rebate 46 in the upper portion of the window frame 45.

Prior to mounting the ventilator 36 on the double glazed unit 47, opposite end portions of the ventilator 36 are each provided with a corresponding one of a pair of end caps 49 (see FIG. 4). Each end cap 49 is a substantially rectangular block comprising an end wall 50 having a recess 51, a pair of bores 52 and 53 and a pair of angled slots 54 and 55.

The arrangement is such that an end wall 50 of one end cap 49 is placed in abutment with one pair of end walls of the extrusions 10 of the ventilator 36 such that one end portion of the flyscreen 44 either enters in or is aligned with a corresponding one of the slots 54,55 and the recesses 29 of the extrusions 10 are aligned with corresponding bores 52,53. Screws then are inserted in the bores 52,53 and screwed into the recesses 29 thereby securing the end cap 49 to the ventilator 36. The process is repeated with the second end cap 49 thereby securing the second end cap 49 to the ventilator 36. The assembly then is mounted on the upper edge 48 of the glazed unit 47 and sealed thereto by means of seals 56 and the unit 47 is inserted in the window frame 45 and sealed therein by means of seals 57, as shown in FIGS. 3 and 5, and the upper portions of the extrusions 10 entering in the rebate 46 such that the skirts 23 are located on adjacent exposed surfaces 58 of the window frame 45.

Movement of the shutters 41,42 is possible, although the shutters may be of the same length as the extrusions 10, because any overlap of an end portion of a shutter 41,42 beyond an end portion of an extrusion 10 is accommodated by the recess 51 in the adjacent end cap 49.

Operation in unison of the shutters 41, 42 is achieved by means of a device 59 shown in FIG. 6. The device 59 comprises a U-shape component which extends in line with the shutters 41,42 at one end of the shutters. Two spaced parallel walls 60,61 of the component each have a series of teeth 62 extending along an upper edge thereof, a series of longitudinal spaced parallel ridges 63 on an outer surface thereof and a longitudinal step 64 on an inner surface thereof. Each of the walls 60,61 is straddled by a corresponding one of a pair of locators 65.

Each of the locators 65 comprises a panel 66 of a dimension such as to be received in any one of the apertures 43 of the shutters 41,42 without any significant relative movement, a lug 67 extending in spaced parallel relationship to the panel 66 and a bridge member 68 connecting the panel 66 to the lug 67.

Each panel 66 is provided with a lower inwardly extending abutment surface 69; each lug 67 is provided with a lower inwardly extending flange 70 and each bridge member 68 is provided with depending teeth 71 complementary with the teeth 62 upstanding from the walls 60,61.

The operating device 59 is positioned such that the walls 60,61 extend outwardly and longitudinally of corresponding shutters 41,42. The locators 65 are moved longitudinally of the corresponding walls 60,61 until the panels 66 are correctly positioned to register with corresponding first apertures 43 at an adjacent end of each of the shutters 41,42. The locators 65 then are urged downwardly of the corresponding walls 60,61 such that the teeth 71 of the locators 65 engage corresponding teeth 62 of the walls 60,61 and the abutment surface 69 and the flange 70 of each locator 65 engage under a corresponding step 64 and ridge 63 of a corresponding wall 60,61 thereby securing each locator 65 in each selected position relative to the corresponding wall 60, 61.

The operating device 59 includes a knob 72 for moving the device 59 in a longitudinal direction. Although not shown, the knob 72 extends between a lip 24 and a sloping surface 33 of an extrusion 10.

It will be appreciated that by providing the operating device 59 there is no wastage of material when the extruded components are cut to size, unlike with strip ventilators known hitherto in which it is necessary to provide a larger aperture at one end portion of each extruded length of shutter stock or, alternatively, by arranging that a cut-off position coincides with an aperture.

Instead of operating the operating device 59 by means of the knob 72, the device may be provided with a cord operating component. This comprises an elongate panel 73 having two downwardly extending slots 74 and 75 spaced longitudinally one from another, an upwardly extending elongate slot 76 between the two downwardly extending slots 74,75 and a tab 77 extending in a longitudinal direction at one end thereof. A corresponding panel (not shown) also is provided which is similar except that the corresponding panel is not provided with slots 74,75 and 76.

A cord 78 is attached at its mid-point to a support for the operating knob 72 and opposite ends of the cord 78 are guided through the corresponding slots 74,75 of the panel 73. The panel 73 then is located such that the slot 76 straddles the operating knob 72 and the tab 77 is received in an adjacent angled slot 55 of the adjacent end cap 49. The corresponding panel is located on an opposite side of the assembly, the tab of the panel being received in the other angled slot 54 of the adjacent end cap 49.

By pulling on one or the other of the ends of the cord 78, the operating device 59 can be moved longitudinally to effect operation of the shutters 41,42.

It will be appreciated, that the connecting members 37, 38 connect the pair of extrusions 10 such that the extrusions 10 are in spaced relation one with another. The connecting members 37, 38 thus provide the ventilator 36 with a thermal break.

It will also be appreciated that the dimensions of the connecting members 37, 38, in cross section are such that a selected ventilator 36 is locatable on a selected double glazed unit 47. The connecting member 37 and upper portions of corresponding extrusions 10 are reproduced in FIG. 8. The connecting member 37 comprises a pair of depending spaced parallel elongate webs 79, 80 each associated with a corresponding one of the inwardly turned flanges 39,40. However, for narrower spacing between glazed panels of a double glazed unit 47 only a single web may be necessary, as with the connecting member shown at 81 in FIG. 7. Alternatively, for wider spacing between glazed panels of a double glazed unit 47 it may be necessary to provide a connecting member, as shown at 82 in FIG. 9, in which two spaced parallel elongate webs 83,84 are provided wherein the separation is greater compared with the distance separating the webs 79,80 of the connecting member 37.

With each of the connecting members 37, 81 and 82 chamfered surfaces 85 are provided for co-operating with corresponding chamfered surfaces 86 of the extrusions 10 so that the connecting members 37, 81 and 82 are adapted easily to be forced into snap engagement with the extrusions 10.

It will also be appreciated that each of the end caps may be provided with a lower aperture, as shown at 87 in FIG. 4, for drainage purposes in use.

Referring now to FIGS. 10 to 13 of the drawings, there is shown an extrusion 88 of aluminium comprising a lower portion 89, an upper portion 90 and an intermediate portion 91. The lower portion 89 is of substantially inverted U-shape transverse cross section. The upper portion 90 comprises an upwardly extending elongate web 92. The intermediate portion comprises a rectilinear wall 93, a curved wall 94 and upper and lower bridge portions 95,96 connecting the walls 93,94 in spaced relation one to another.

The rectilinear wall 93 is provided with a series of square apertures 97 extending longitudinally of the extrusion 88. The curved wall 94 extends downwardly from the upper bridge portion 95 in a direction parallel to the rectilinear wall 93, then curves outwardly away from the rectilinear wall 93 to form a skirt 98 having a lower lip 99. The curved wall 94 is provided with an internal longitudinally extending projection 100 which defines an internal longitudinally extending recess 101 at the junction of the curved wall 94 and the skirt 98. The skirt 98 is of such dimension that the distance of the lip 99 from the upper bridge portion 95 is at least as great as the distance of lower margins of the apertures 97 in the rectilinear wall 93 from the upper bridge portion 95.

The upper bridge portion 95 is provided with an inwardly extending longitudinal projection 102 defining a longitudinal recess 103 adjacent the rectilinear wall 93 and a longitudinal recess 104 remote from the rectilinear wall 93. Similarly, the lower bridge portion 96 is provided with an inwardly extending longitudinal projection 105 defining a longitudinal recess 106 adjacent the rectilinear wall 93 and a longitudinal recess 107 remote from the rectilinear wall 93. The lower bridge portion 96 outwardly of the outer recess 107 slopes downwardly in a direction from the rectilinear wall 93, as shown at 108. The upper and lower bridge portions 95,96 are each provided with a recess adjacent the rectilinear wall 93 at a side thereof remote from the curved wall 94, as shown at 109, 110.

Referring now to FIG. 12 of the drawings, there is shown a strip ventilator III comprising the extrusion 88 and a shutter 112 provided with a series of square apertures 113 similar to the square apertures 97 of the extrusion 88, the shutter 112 being located in the recesses 109, 110 of the extrusion 88 and slidable therein in a longitudinal direction of the extrusion 88. The ventilator III also includes an elongate mesh flyscreen 114 which is received in the recesses 101, 107 of the extrusion 88. The ventilator III is located in a window frame 115 having a rebate 116 and a glazed panel 117 an upper edge of which is spaced from an upper portion of the frame 115 such that, when the lower portion 89 of the ventilator III is received on the upper edge of the glazed panel 117, the upper web 92 is received in the rebate 116.

Prior to mounting the ventilator III on the glazed panel 117, opposite end portions of the ventilator III are each provided with a corresponding one of a pair of end caps (see FIG. 13). A gasket 118 is located on an upper edge of the glazed panel 117 and the ventilator III is mounted on the glazed panel 117 such that the gasket 118 seals any gap between the glazed panel 117 and the extrusion 88 of the ventilator III.

Operation of the shutter 112 is achieved by means of a device 119 shown in FIG. 13. The device 119 comprises an elongate panel 120 which is located in spaced parallel relationship with an end portion of the shutter 112. An upper surface of the panel 120 is formed as a series of teeth 121 extending longitudinally of the panel 120 and a face 122 of the panel remote from the shutter 112 is provided with a series of longitudinal spaced parallel ridges 123. The panel 120 is straddled by a locator 124 comprising a projecting surface 125 of a dimension such as to be received in any one of the apertures 113 of the shutter 112 without any significant relative movement, a lug 126 extending in spaced parallel relationship to the panel 120 and a bridge member 127 connecting the panel 120 to the lug 126. The bridge member 127 is provided with a series of teeth 128.

The operating device 119 is engaged with the shutter 112 by moving the locator 124 longitudinally of the panel 120 until the projecting surface 125 of the locator 124 is in register with a first aperture 113 at an adjacent end of the shutter 112. The locator 124 then is urged downwardly of the panel 120 such that the teeth 128 of the bridge member 127 engage corresponding teeth 121 of the panel 120 and the lug 126 of the locator 124 engages under a corresponding ridge 123 of the panel 120 thereby securing the locator 124 in a selected position relative to the panel 120.

The operating device 119 includes a knob 129 for moving the device 119 in a longitudinal direction. The knob 129 is located in an elongate slot 130 of a panel 131 formed integrally with an end cap 132.

Instead of operating the operating device 119 by means of the knob 129, the device may be provided with a cord 133. For this purpose, the panel 131 is provided with apertures 134, 135 for receiving the cord 133 and the cord 133 is secured at its mid-point to the knob 129.

By pulling on one or the other of the ends of the cord 133, the operating device 119 can be moved longitudinally to effect operations of the shutter 112.

We claim:

1. A ventilator comprising an elongate strip including a first portion for receiving an edge of a glazed panel, a second portion for location in a window frame and an intermediate portion having a plurality of openings, an elongate shutter moveable longitudinally relative to the intermediate portion for controlling airflow through said openings, an elongate cowl extending longitudinally of said strip, means for locating a fly screen between said strip and said cowl wherein said strip, said cowl and said means comprise a single unitary component and operating means for moving said shutter relative to said intermediate portion said operating means comprising an elongate member and an abutment member for cooperating with said shutter and carried by said elongate member, said abutment member being adapted to be selectively located longitudinally of said elongate member.

2. A ventilator as claimed in claim 1 wherein said elongate member and said abutment member are provided with cooperating snap engagement means for securing said elongate member and said abutment member one to another.

3. A ventilator comprising a pair of elongate strips each having a plurality of openings, connecting means for connecting said strips in spaced parallel relationship one to another wherein said connecting means is adapted for snap engagement with said pair of elongate strips, shutter means for controlling airflow through said openings and operating means for operating said shutter means wherein said operating means comprises an elongate member and abutment means for cooperating with said shutter means and carried by said elongate member, said abutment means being adapted to be selectively located longitudinally of said elongate member.

4. A ventilator as claimed in claim 3 wherein said elongate member and said abutment means are provided with cooperating snap engagement means for securing said elongate member and said abutment means one to another.

5. A ventilator comprising a pair of identical elongate strips each including a first portion for receiving an edge of a glazed panel, a second portion for location in a recess of a window frame and an intermediate portion having a plurality of openings, means for connecting the strips in spaced parallel relationship one to another, and shutter means moveable longitudinally relative to the intermediate portions for controlling airflow through said openings.

6. A ventilator as claimed in claim 5 wherein there is provided operating means for moving said shutter means relative to said intermediate portions said operating means comprising an elongate member and an abutment member for cooperating with said shutter means and carried by said elongate member, said abutment member being adapted to be selectively located longitudinally of said elongate member.

7. A ventilator as claimed in claim 6 wherein said elongate member and said abutment member are provided with cooperating snap engagement means for securing said elongate member and said abutment member to one another.

8. A ventilator as claimed in claim 5 wherein a portion of said intermediate portion extends into the recess of the window frame.

9. A ventilator comprising a pair of identical elongate strips each including a first portion for receiving an edge of a glazed panel, a second portion for location in a recess of a window frame and an intermediate portion having a plurality of openings, means for connecting the strips in spaced parallel relationship one to another, shutter means moveable longitudinally relative to the intermediate portions for controlling air flow through said openings and operating means for operating said shutter means, the elongate strips being of a profile whereby said intermediate portions also extend into said recess.

* * * * *